United States Patent [19]

Turetsky

[11] Patent Number: 4,488,530

[45] Date of Patent: Dec. 18, 1984

[54] CONTROLLING AND SWITCHING MECHANISM

[76] Inventor: Isadore Turetsky, 23940 Welby Way, Canoga Park, Calif. 91307

[21] Appl. No.: 604,177

[22] Filed: Apr. 26, 1984

Related U.S. Application Data

[63] Continuation-in-part of Ser. No. 455,817, Feb. 22, 1983, abandoned.

[51] Int. Cl.[3] ..... F02B 29/00

[52] U.S. Cl. ..... 123/477; 123/146.5 A

[58] Field of Search ..... 123/477, 146.5 A

[56] References Cited

U.S. PATENT DOCUMENTS

| | | | |
|---|---|---|---|
| Re. 29,561 | 3/1978 | Ford | 123/477 |
| 3,587,535 | 6/1971 | Kimberley | 123/477 |
| 3,683,577 | 8/1972 | Mennesson | 123/477 |
| 3,720,190 | 3/1973 | Mennesson | 123/477 |
| 3,720,192 | 3/1973 | Aono | 123/477 |
| 3,720,193 | 3/1973 | Monpedid | 123/477 |
| 3,895,612 | 7/1975 | Kcely et al. | 123/477 |
| 3,896,776 | 7/1975 | Ford | 123/146.5 A |
| 3,945,350 | 3/1976 | Ford | 123/477 |
| 4,134,367 | 1/1979 | Ferry et al. | 123/477 |

FOREIGN PATENT DOCUMENTS

| | | | |
|---|---|---|---|
| 2125959 | 12/1971 | Fed. Rep. of Germany | 123/477 |
| 1244630 | 9/1971 | United Kingdom | 123/477 |
| 2231851 | 6/1973 | United Kingdom | 123/477 |

*Primary Examiner*—Raymond A. Nelli

[57] ABSTRACT

A controlling and switching mechanism utilizing radiant energy to activate each radiant energy sensitive switching member for applying an energizing pulse to its associated fuel injector of an internal combustion engine; the mechanism having at least one element disposed between a revolving or recurring beam of said radiant energy and said switching member which controls the actuating means of its associated fuel injector; said element having an aperture and shutter therein for each switching member so that each aperture and shutter will be in a similar relative position with their associated switching member. The mechanism has means for exposing part of said member to said radiant energy by means of the associated aperture and shutter; the duration of an energizing pulse, in degrees of engine shaft rotation, is a function of the position of that part of the switching member exposed to the radiant energy.

11 Claims, 13 Drawing Figures

Fig. 10.
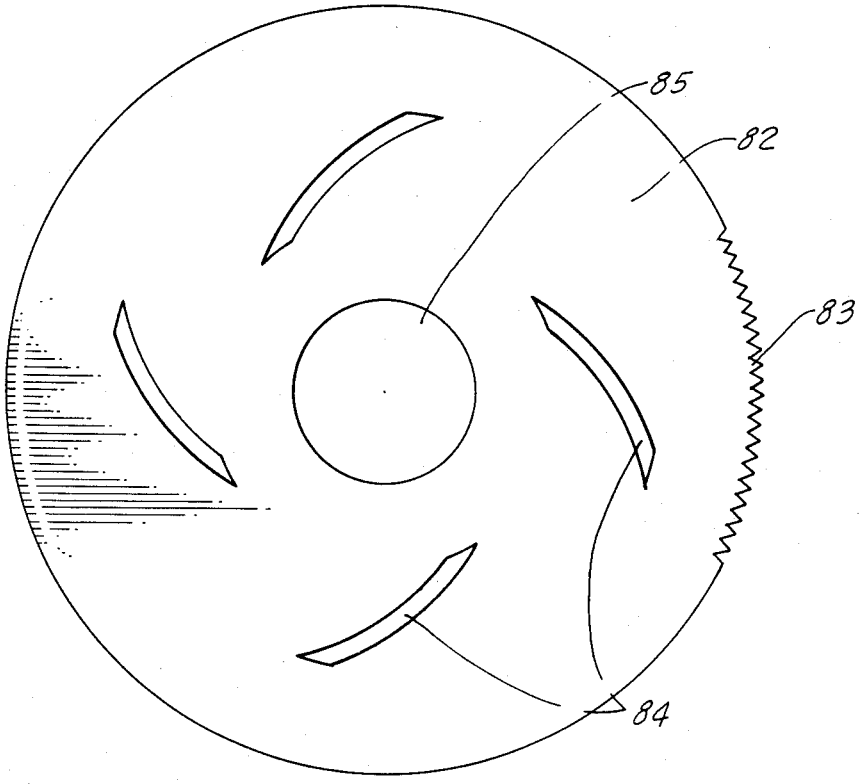
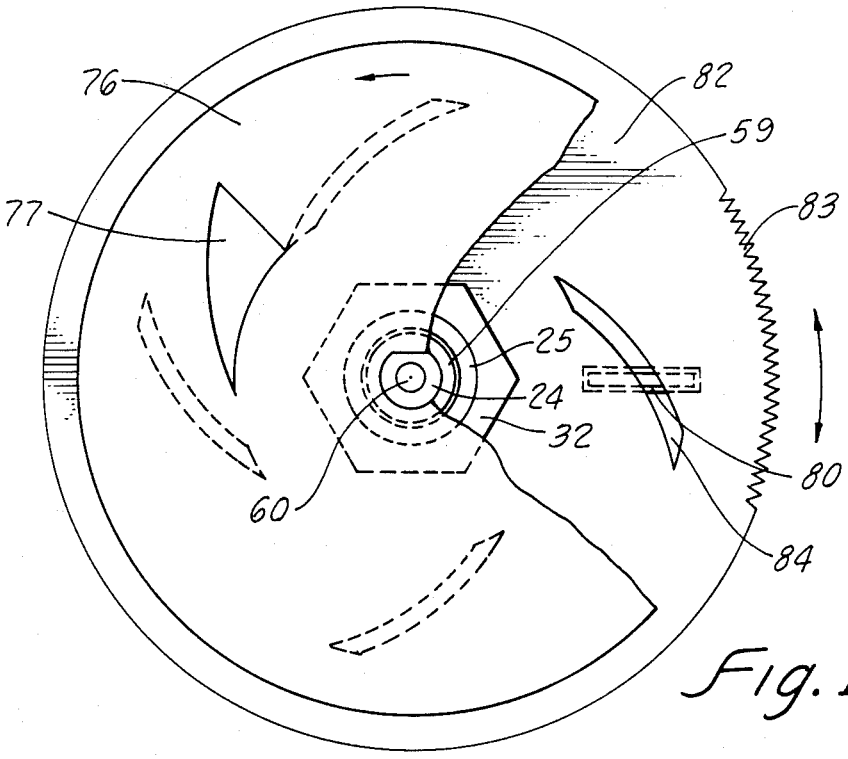
Fig. 11.

Fig. 12.
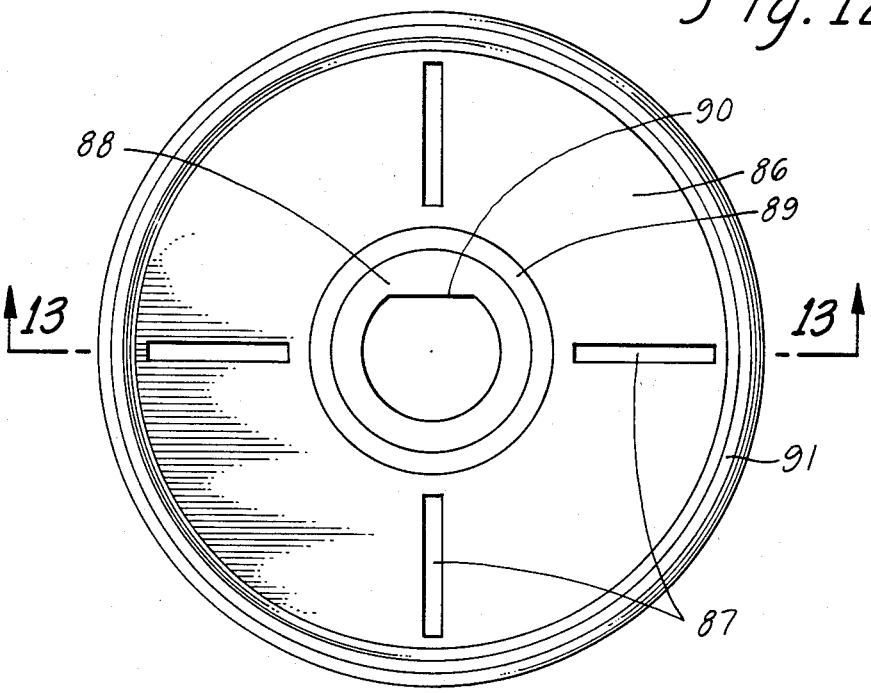
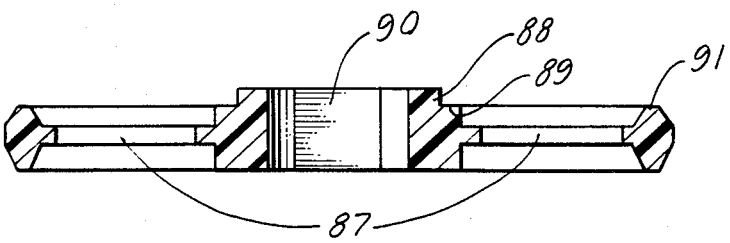
Fig. 13.

CONTROLLING AND SWITCHING MECHANISM

Cross-reference to related applications: This application is a continuation-in-part of my initial co-pending application, U.S. Pat. application Ser. No. 455,817, now abandoned, filed on Feb. 22, 1983, and entitled "Controlling and Switching Mechanism."

Field of the Invention: This invention relates to electromechanical controlling and switching mechanisms activated by radiant energy, preferably light, for use in a fuel injection system of an internal combustion engine.

Several devices utilizing radiant energy, and photo responsive members have been designed for use in the fuel injection systems of internal combustion engines.

Some systems utilize a disk rotating in timed relationship with the engine, and having one or more apertures therein; said disk rotating between a light source and one or more photo responsive cells. The intermittent light signals are transmitted to the cells in proper sequence for generating an output pulse to actuate the fuel injectors. The duration said fuel injectors remain actuated to deliver fuel is determined by a time delay circuit which is regulated by a relatively complex electronic control unit.

One system uses a trigger contact mechanism to generate pulses in proper sequence, and a relatively complex electronic control unit to regulate the time delay circuit for proper fuel injection.

Still another system uses an opaque element having a tapering slot, said element being disposed between the source of radiation and the members responsive to said radiation. The duration of the output pulse is governed by the position of the slot relative to said members, and is varied by axially shifting the radiation sensitive members or the opaque element which rotates in timed relationship with the engine. Such an arrangement is mechanically difficult to maintain for precise timing.

Object of the Invention: It is an object of my invention to provide a switching mechanism having relatively simple means with which to control the duration of an energizing pulse to each fuel injector of an internal combustion engine.

Another object of the invention is to offer a simple means for timing the energizing pulse to each fuel injector.

Embodiments of my invention capable of accomplishing the foregoing objects and providing the advantages contemplated by them and other advantages will become more apparent after studying the detailed description of the following specification which may be readily understood by reference to the accompanying drawings.

BRIEF DESCRIPTION OF THE DRAWINGS

FIG. 10 illustrates a plan view of the intermediate control disk which is used in combination with upper and lower disks shown in FIG. 8 and FIG. 9 respectively.

FIG. 11 is a plan view of the disk shown in FIG. 8, said disk in position on the shaft with several adjacent members removed, and having a breakaway section for clarity.

FIG. 12 shows a plan view of an optional disk which can be disposed between the lower disk shown in FIG. 9 and the intermediate disk illustrated in FIG. 10.

FIG. 13 is a transverse sectional view taken along line 13—13 of FIG. 12.

DETAILED DESCRIPTION OF THE DRAWINGS

Figure 1:
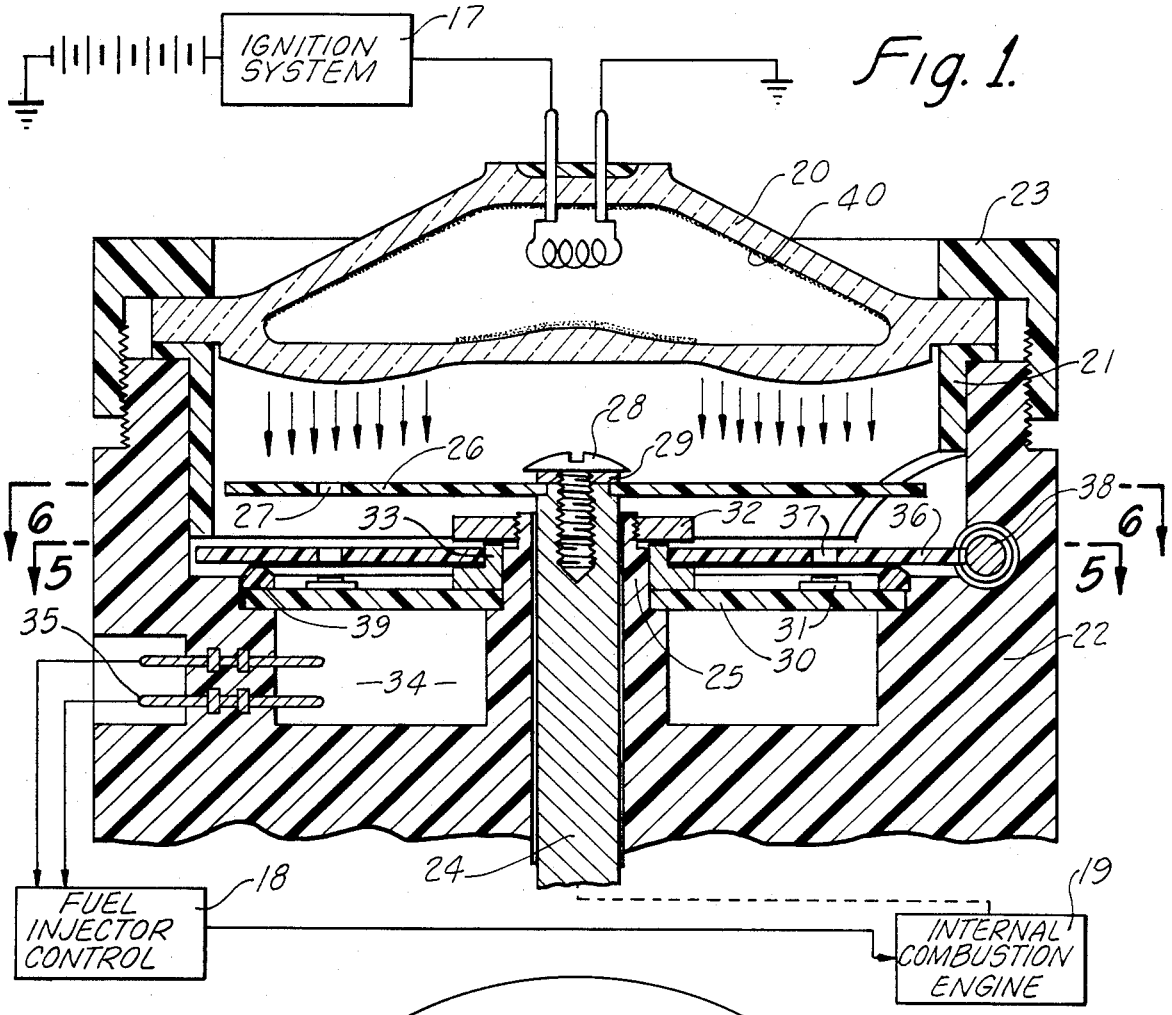
FIG. 1 is a sectional view of the switching mechanism housing illustrating the relative positions of members enclosed within said housing.

Referring to FIG. 1 which is for illustrative purposes only, the preferable sealed beam lamp 20 is disposed on the shoulder of spacer-gasket 21, said gasket resting on the upper end wall of switching mechanism housing 22. The lamp 20 is held in a fixed position by means of threaded ring nut 23 which is screwed onto the threaded upper end section of housing 22. The shaft 24 passes through the bore of internally extended hub 25 of housing 22 so that one end of said shaft extends above the end of said hub 25; the shaft 24 being coupled by gears or other suitable means so that said shaft operates in timed relationship with the engine crankshaft. The shaft 24 can be coupled to the distributor timing shaft of the internal combustion engine 19. The upper disk 26 which has an aperture 27 is positioned at the upper end section of shaft 24 by means of a flat surface (not shown) on said upper end section, and a flat surface on the otherwise concentric bore of disk 26. The disk 26 is held in position by means of screw 28, and lockwasher 29 which is disposed between the head of said screw 28 and disk 26. The lower disk 30 having a plurality of light activated switching members 31 is placed in position by means of a flat surface (not shown) on its otherwise concentric bore; said flat surface being disposed adjacent to a flat surface on the hub 25. The lower disk 30 is held in position by means of threaded nut 32 which is screwed onto the upper threaded end section of hub 25, and bears against collar 33 which is disposed between said nut 32 and disk 30. The concentric raceway 34 facilitates placing and connecting each of the wires (not shown) to their respective switching member, and to their associated connector pins 35 which are adapted for insertion into a plug (not showh) for electrically connecting the switching members to the fuel injector control 18, so that each light sensitive switching member is connected in electrical circuit to its associated fuel injector; the number of switching members 31 is equal to the number of fuel injectors in the fuel injection control system 18. The preferabley opaque disk 35 disposed intermediate disks 30 and 26 has an aperture 37 for each switching member 31 fixed on disk 30, with which to govern the length of each light activated switching member 31 sequentially exposed to a beam of radiation from sealed beam lamp 20. A sector of disk 36 has a series of gear teeth at its outer circumference which mesh with teeth of circular rack gear 38. A section of collar 33 fits in the concentric bore of disk 36, said disk resting on the shoulder of said collar, and also supported by a preferable teflon ring gasket 39 which rests against the upper face next to the periphery of disk 30. The collar 33 is of sufficient length so that a clearance exists between disk 36 and nut 32. By use of the circular rack gear 38 which is enclosed within housing 22 the disk 36 can be moved (rotated) to a desired position and held stationary at that position. The sealed beam lamp 20 which is preferably electrically connected to the ignition system 17 can have selected reflective surfaces 40 so that a ring of light (as shown by arrows) will be directed toward the rotating disk 26 when the ignition system is energized.

Figure 2:
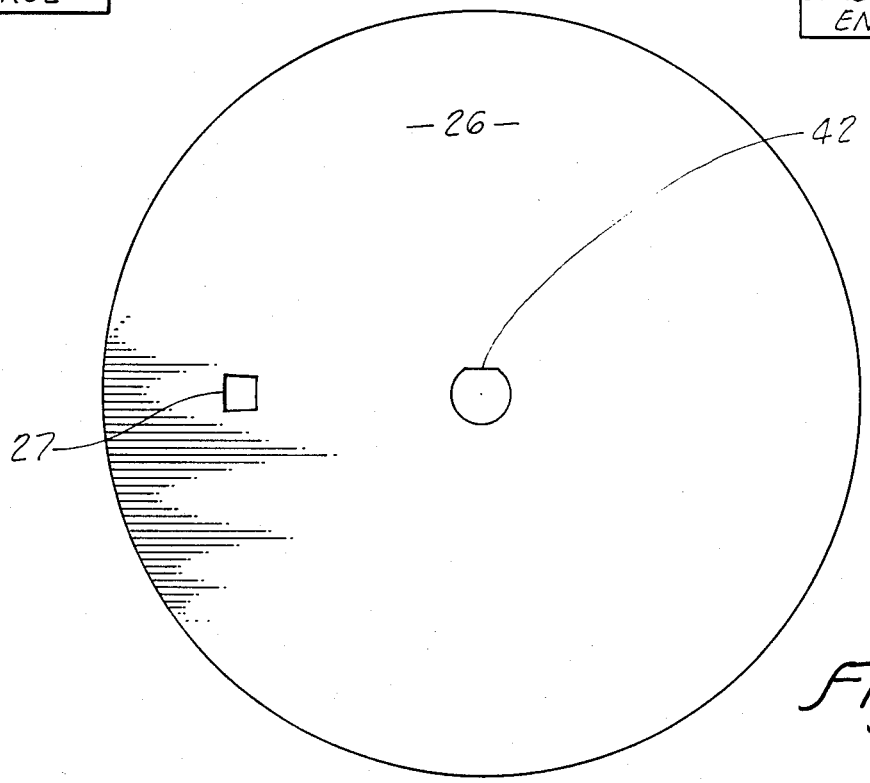
FIG. 2 is a plan view of the upper disk of the switching mechanism shown in FIG. 1.

FIG. 2 shows a plan view of the upper disk 26 which rotates in timed relationship with the engine crankshaft. Shown is the flat surface 42 across the otherwise concentric bore, and the aperture 27.

Figure 3:
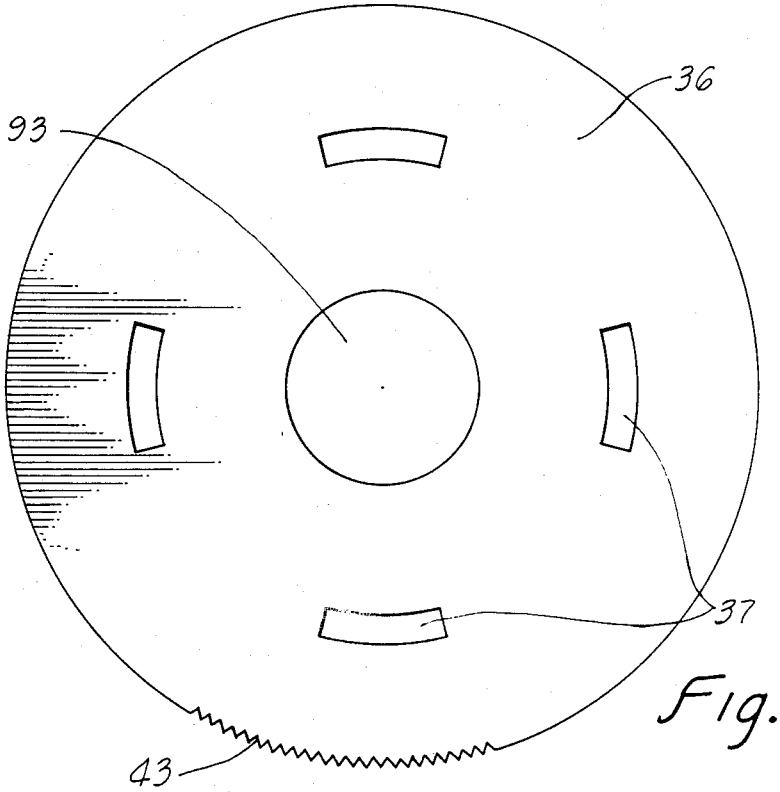
FIG. 3 is a plan view of the intermediate disk of the switching mechanism shown in FIG. 1.

FIG. 3 shows a plan view of intermediate disk 36 having gear teeth 43 at the outer circumference of a sector of said disk. Also shown are a plurality of apertures 37, and a concentric bore 93; the number of apertures 37 being equal to the number of light activated switching members fixed on the lower disk.

Figure 4:
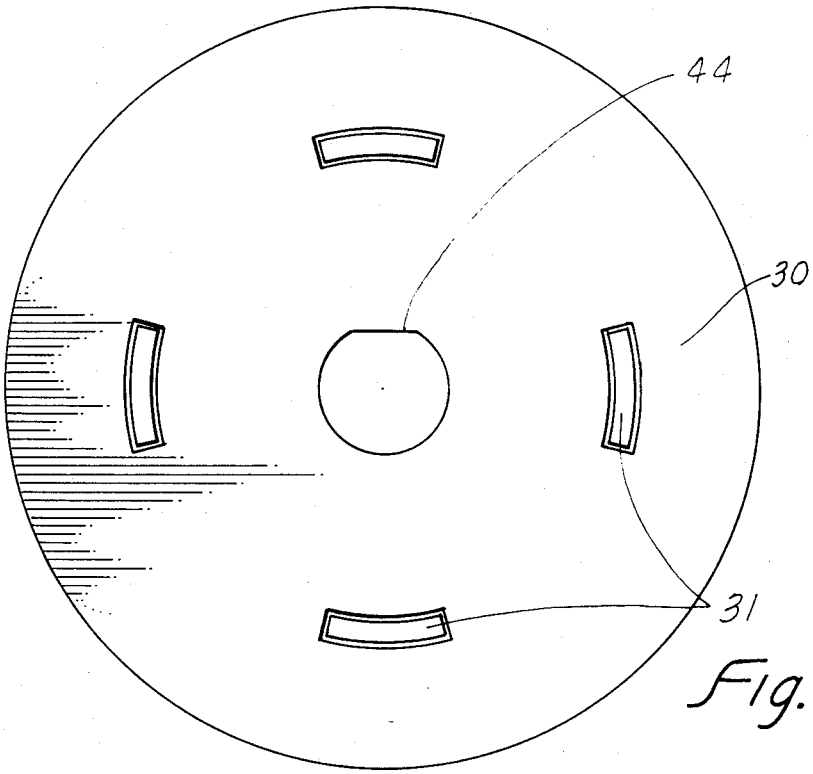
FIG. 4 is a plan view of the lower disk and its radiation activated members.

FIG. 4 is a plan view of the lower disk 30 having a plurality of light activated switching members 31 with the electrical connections not shown. The disk can preferably be made of plastic or other non-metallic material, and have printed circuits to facilitate manufacturing precision and economy. It will be obvious to one skilled in the art that the light responsive members 31 can be phototransistors, or photodiodes. Also, the source of radiation can be light emitting diodes. The flat surface 44 of the otherwise concentric bore of disk 30 is used to located and hold said disk in position within the housing; said flat surface 44 disposed adjacent the flat section of the internally extended hub.

Figure 5:
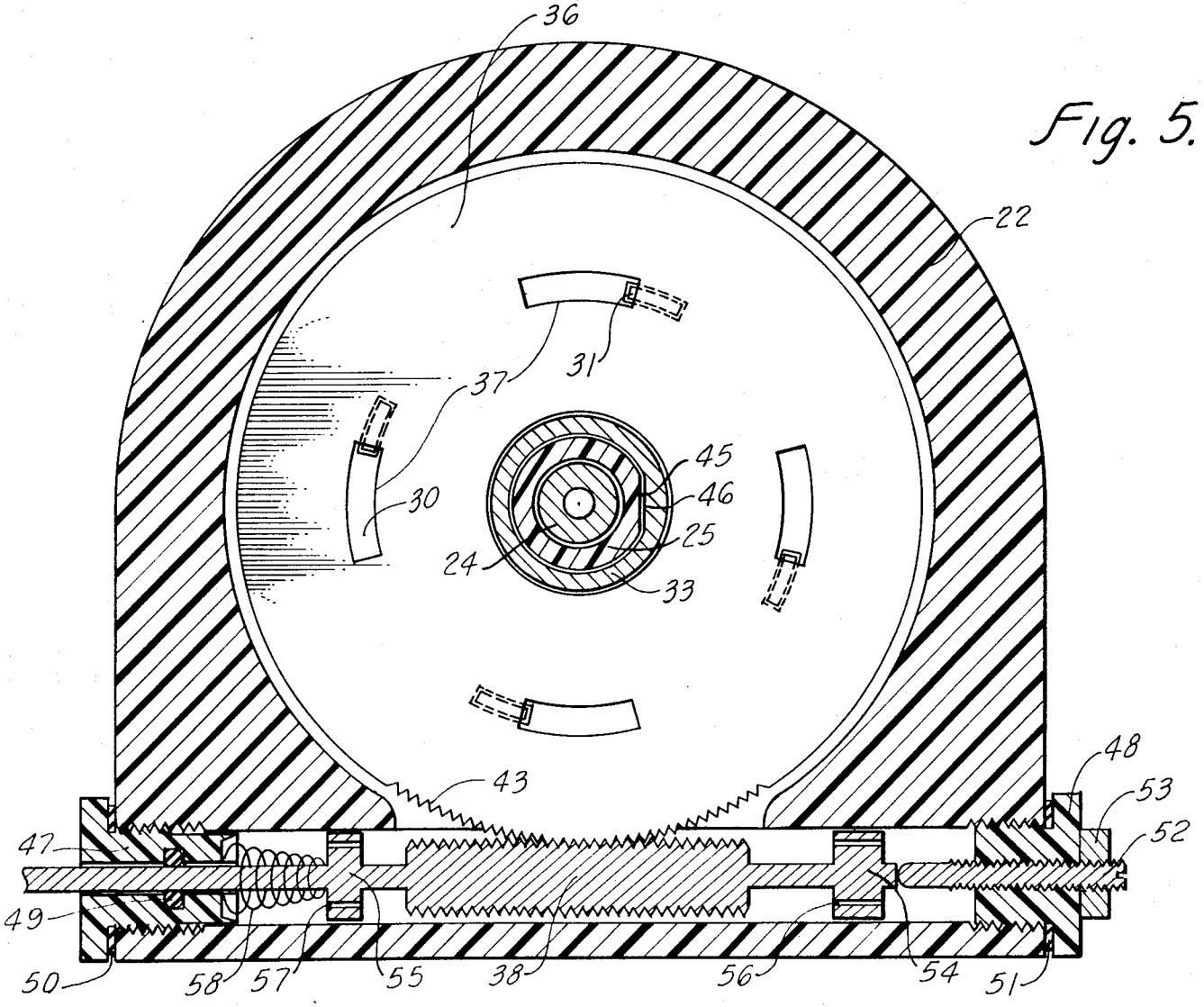
FIG. 5 is a sectional view taken along line 5—5 of FIG. 1.

FIG. 5 is a transverse sectional view taken along line 5—5 of FIG. 1 and shows the controlling intermediate disk 36 with its apertures 37 and gear teeth 43 which mesh with teeth of circular rack gear 38. Also shown is a section of the shaft 24, the internally extended hub 25, the flat surface 45 on said extended hub, and the flat surface 46 in the otherwise concentric bore of collar 33. The circular rack gear 38 is enclosed within housing 22 by means of straight threaded gland nut 47 and idling screw retaining nut 48; said gland nut 47 retaining an "O" ring 49 which is disposed around the extended control shaft of rack gear 38 to facilitate keeping the interior of housing 22 clean. Also disposed between the shoulder of gland nut 47 and the housing 22 is gasket 50. Located between the shoulder of idling screw retaining nut 48 and housing 22 is gasket 51. The threaded idling adjusting screw 52 is held in position within retaining nut 48 by means of locknut 53. The rack gear 38 is supported by its two integral collars 54 and 55 having passages 56 and 57 respectively. The collar 54 rests against the idling adjusting screw 52 during idling engine operation. The spring 58 disposed between collar 55 and gland nut 47 is under compression so as to return the rack gear 38 to idle position when the controlling force applied to the extended shaft of said rack gear is released. It will be obvious that ihe unit can be adapted to use an external spring under tension to return the controlling rack gear to idle position. Passages 56 and 57 in collars 54 and 55 respectively prevent the entrapment of air on either side of said collars and tend to facilitate proper operation of the rack gear 38. Also shown through each aperture 37 is a section of lower disk 30 and an exposed section of each associated light activated switching member 31. It will be noted that moving the rack gear to rotate disk 36 clockwise will expose a longer section of each light activated switching member by means of its associated aperture 37.

Figure 6:
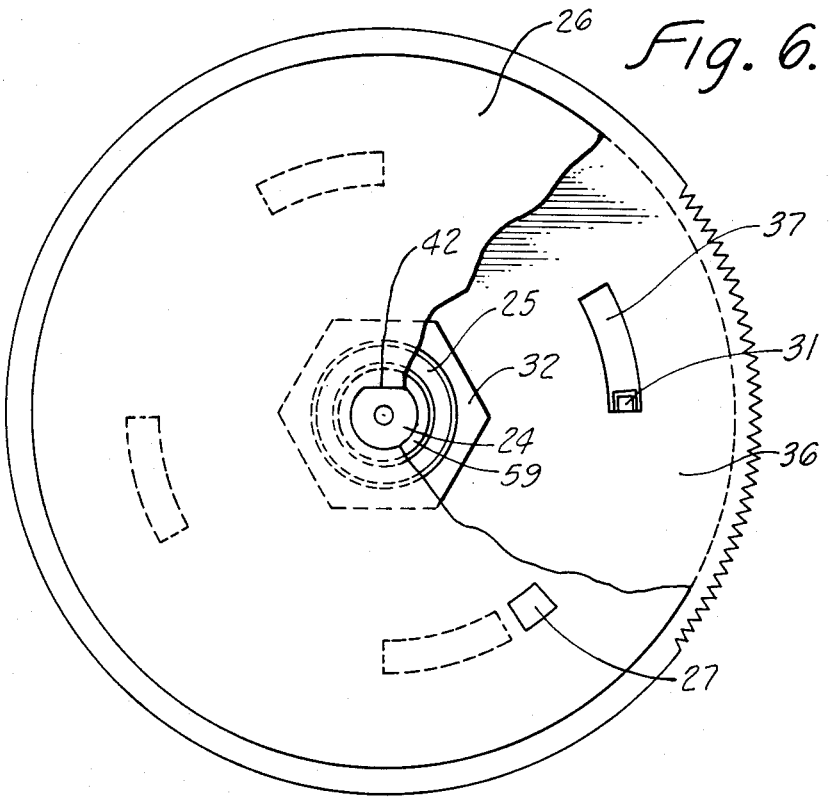
FIG. 6 shows a plan view of the upper disk disposed in position on the shaft with several adjacent members removed, and having a breakaway section for clarity.
Figure 7:
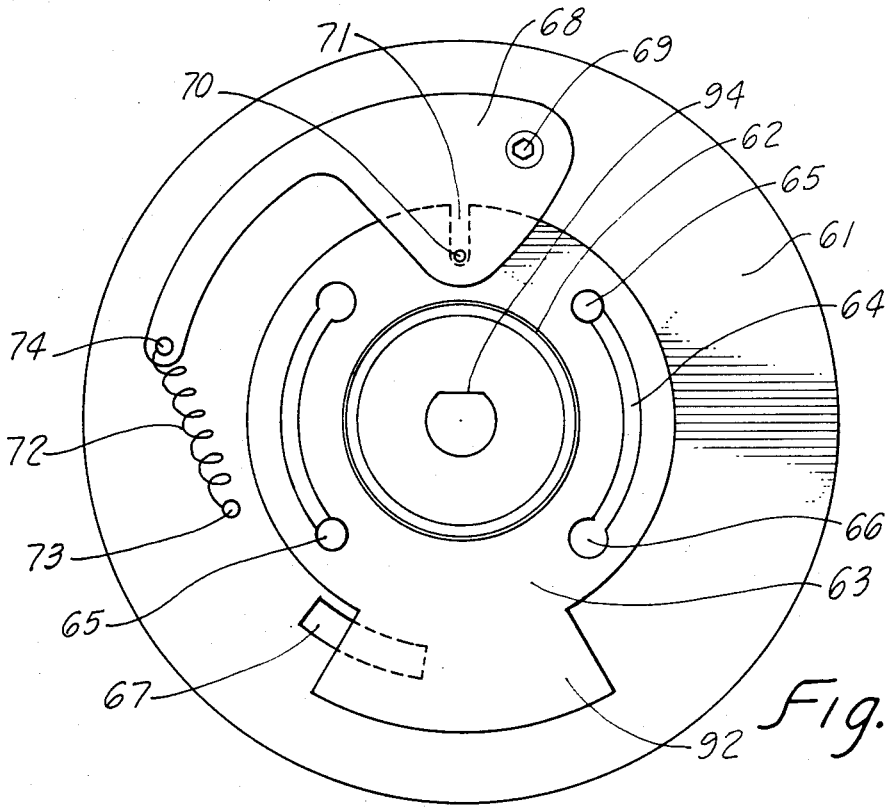
FIG. 7 illustrates a plan view of a modified disk which can be used in place of the disk shown in FIG. 2.

FIG. 6 shows a plan view of disk 26 in position as illustrated in FIG. 1 with several adjacent members removed and having a breakaway section for clarity. Shown is the aperture 27 of disk 26. Also shown is the flat surface 42 across the otherwise concentric bore of disk 26, said flat surface adjacent a flat surface at the upper end section of shaft 24. The disk 26 rests on shoulder 59 located at the upper end section of shaft 24. The screw (and its lockwasher) which holds disk 26 in fixed position with shaft 24 has been removed from the threaded centerbore of said shaft. Shown is a section of nut 32 screwed onto the threaded upper end section of hub 25. A part of one light activated member 31 of the lower disk is shown exposed by its associated aperture 37 in intermediate controlling disk 36. It will be noted that apertures 37 and light activated members 31 are in a common projected cylindrical ring area, and that the aperture 27 rotates in said common projected ring area. With a ring of light (from the sealed beam lamp) directed toward the rotating disk 26 a beam of light (emanating from aperture 27) will activate the switching member 31 across that length of said member exposed by aperture 37 when the rotating aperture 27 of said disk 26 passes over said exposed length of switching member. The controlling electrical pulse generated by the action of light on the member 31 is transmitted to the fuel injector control to actuate its associated fuel injector. It will be noted that the length of the energizing pulse, in degrees of crankshaft rotation, is a function of the exposed part of the switching member, and that rotation of controlling disk 36 in a clockwise direction will expose more of each switching member to the light passing through aperture 27, resulting in a longer energizing pulse, in degrees of shaft rotation, for delivering more fuel. It will be ovbious to one skilled in the art that although the method of control is unique and will function satisfactorily with a constant speed, variable loaded engine, the method as shown when used with a variable speed engine has several limitations. The response time of the light activated switching members is limited by the fixed size of the rotating aperture at full speed. In addition, given a minimum limit of the exposed length of said switching members, too large an aperture 27 will result in a relatively long energizing pulse at idle speed which may not be desirable. Also, as engine speed is increased, the aperture 27 rotates past the switching members that much faster, so that a longer aperture 27 may be required. One solution would be a variable aperture in the rotating disk as shown in the following FIG. 7. FIG. 7 illustrates an optional disk 61 which can be used in place of disk 26. The disk 61 has a concentric ring projection 62 around which is placed a second disk 63. This second disk 63 has two diametrically opposed similar apertures 64 which receive the guide pins 65 fixed to disk 61. The upset heads of guide pins 65 keep the disk 63 from being removed unless said disk 63 is rotated so that the enlarged end 66 of each aperture is directly under the upset head of its respective pin, at which time disk 63 can be removed; the upset heads being smaller in diameter than the enlarged ends 66. The aperture 67 in disk 61 is partly covered by the dovetail shutter section 92 of disk 63 so that light will pass through a relatively small part of said aperature during idle engine speed. The weight 68 can rotate about pin 69 which is fixed to disk 61, said pin having an upset head so that weight 68 will not separate from disk 61. Fixed to weight 68 is pin 70 which slides in slot 71 of disk 63. The spring 72 is connected to fixed pin 73 in disk 61, and to the arm of weight 68 by means of hole 74 in said arm. The flat surface 94 of the otherwise concentric bore of disk 61 is disposed adjacent the flat surface of the rotating shaft. Using this assembly for the upper disk, it will be noted that as the rotational velocity of disk 61 increases, centrifugal force will tend to rotate weight 68 about pin 69 so that pin 70 will shift in slot 71 of disk 63 and rotate said disk 63 counter clockwise to expose more of the aperture 67 in disk 61. The effective length of a beam of radiant enerry emanating from a rotating aperture having a constant arc length can thus be varied. The stiffness constant of spring 72 and the exposed length of the light activated switching members will also govern the speed and therefore the exposed length of aperture 67 at a given engine speed.

The effect of an aperture rotating in timed relationship with the engine shaft can be varied by another simpler means using different disks in combination, as will be described in the following figures.

Figure 8:
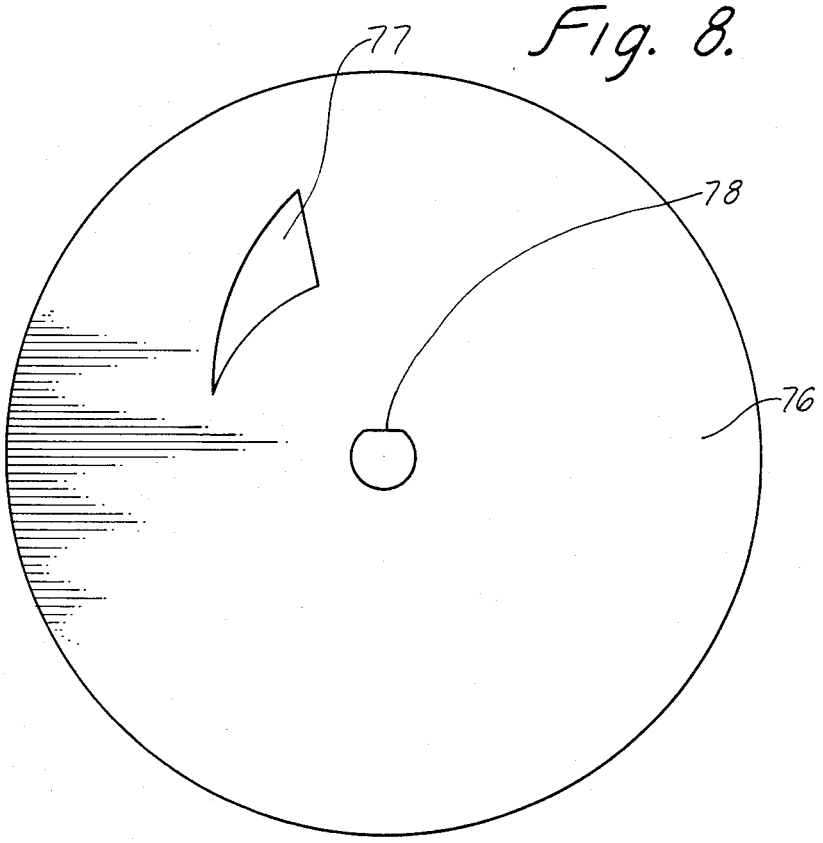
FIG. 8 shows a plan view of a disk which can be used as the upper disk in combination with two other special disks.

FIG. 8 illustrates an upper disk 76 which can be used in combination with two special disks, and which rotates in timed relationship with the engine crankshaft. The length of a circular section of aperture 77 varies inversely as its distance from the center of disk 76. The flat surface 78 on the otherwise concentric bore of disk 76 is used to position said disk on the rotating shaft of the switching mechanism.

Figure 9:
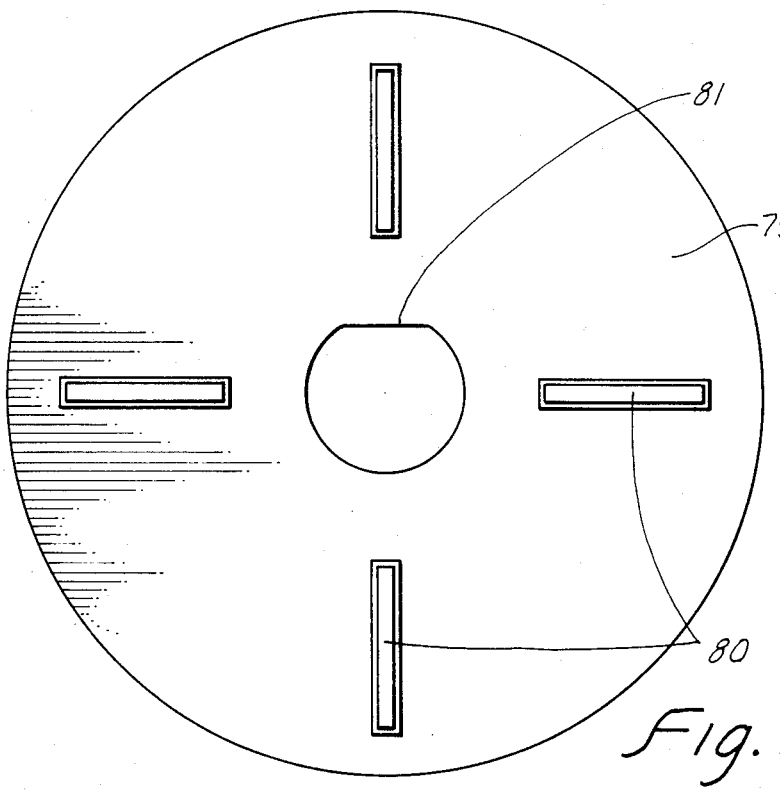
FIG. 9 is a plan view of the lower disk with its radiation activated members used in combination with the disk shown in FIG. 8 and an intermediate disk.

FIG. 9 illustrates the lower disk 79 which is used in combination with disk 76. It will be noted that the fixed light sensitive switching members 80 extend radially on the disk which is preferably made of plastic or other non-metallic material having printed circuits. The flat surface 81 across the concentric bore positions the disk on the internal extended hub of the switching mechanism housing.

FIG. 10 illustrates the intermediate controlling disk 82 for use in combination with upper and lower disks 76 and 79 respectively. Shown around a section of the outer circumference are gear teeth 83 for meshing with teeth of the circular rack gear. Also shown are the curved radial apertures 84, and the concentric bore 85

FIG. 11 shows a plan view of upper disk 76 in position on shaft 24 with several adjacent members removed and having a breakaway section for clarity. Shown is a section of the shoulder 59 at the upper end section of shaft 24 upon which disk 76 rests. Also shown is the threaded centerbore 60 from which the screw (and its washer) has been removed. The breakaway section exposes a section of intermediate disk 82. A curved radial aperture 84 in disk 82 exposes a part of its associated switching member 80 of the fixed lower disk. Shown are the gear teeth 83 of intermediate disk 82, and the aperture 77 in upper disk 76. Also illustrated is a section of nut 32 which is screwed onto the threaded upper end section of internal hub 25. For explanatory purposes the upper disk is shown rotating in a counterclockwise direction with the engine under partial load, and a cylindrical ring of light (not shown) is projected toward said upper disk 76. That exposed part of light activated switching member 80 will be acted upon by a beam of light when the rotating aperture 77 passes over said exposed part. The activated member 80 will generate an electrical pulse to initiate operation of its associated fuel injector. Rotating the intermediate control disk 82 in a counterclockwise direction will expose a part of the light sensitive member which is more distant from the center of the disk. Since the effective length of a circular section of aperture 77 in disk 76 varies inversely as its radial distance, the length, in degrees of engine shaft rotation, of an energizing pulse will decrease to reduce the engine load. Conversely, rotating the intermediate disk clockwise will expose a part of switching member 80 to a longer effective section of aperture 77 with a resulting increase, in degrees of engine shaft rotation, of an energizing pulse.

While it is preferable to have the lower disk with its light activated switching members in fixed position with the housing, it will be evident that the mechanism can be designed so that the intermediate disk with its apertures is in fixed position with the housing, and said lower disk optionally rotated to vary engine load. It will also be evident that the beam of light emanating from the aperture in the upper disk revolves with respect to the switching members, and that a revolving beam having similar geometric dimensions as said aperture can function in place of said upper disk. The switching members may be activated by individual fixed sources of radiant energy which will emanate through the revolving aperture, the recurring beams revolving with respect to the switching members.

FIG. 12 illustrates an optional disk 86 which can be disposed between intermediate disk 82 and lower disk 79. Shown are apertures 87, each positioned directly above its associated light actuated switching member on the lower disk 79. Also shown is an integral projected hub 88 having a shoulder 89, and a flat surface 90 across the otherwise concentric bore of said hub. A ring projection 91 is located on each side of disk 86 at its periphery. The optional disk 86 can be used to help prevent extraneous light rays from being projected on the lower disk upon which the switching members are fixed. The integral hub 88 the need for collar 33 and ring gasket 39, shown in FIG. 1, when disk 86 is used.

FIG. 13 is a transverse sectional view taken along line 13—13 of FIG. 12 and shows the flat surface 90 within the bore of integral hub 88, the shoulder 89 of said hub, apertures 87, and the ring projection 91 of optional disk 86.

It will be obvious to one skilled in the art that the timing of fuel injection can be adjusted by the similar method used for a common distributor; that is to rotate the housing (with the lower and intermediate control disk) to a desired position, and then similarly fixing the switching mechanism housing. In fact, the mechanical simplicity and precision with which fuel injection timing can be set offer the advantage of a stratified charge prior to ignition, at least during idling and low load speeds. Although the fuel injection control mechanism can be linked to operate with the engine air throttle valve, the precision of fuel injection timing can make the use of an air throttle valve minimal, or depending on cylinder design unnecessary. It will be noted that with the fuel injection timing adjusted by rotating the housing 22 so that the lower disk with its light activated switching members 80 and the intermediate disk are similarly rotated, and thereby shifted with respect to the rotating aperture in the upper disk, the contour of said aperture can affect injection timing with a change of engine load. In addition, it is desirable for the fuel injection timing to advance with increased engine speed by means of a centrifugal advance mechanism as used in a common distributor.

With the engine at idle operating speed the fuel injection timing can be adjusted to end several degrees before the intake valve of the associated cylinder closes (or before induction ends), so that fuel is injected during the latter part of the intake stroke. This will result in a heterogeneous charge within the cylinder which is inherently held in stratified relationship during compression; the richer mixture being substantially disposed in the vicinity of the spark plug before ignition. With increased engine speed the timing of fuel injection is automatically advanced, and since more fuel will be injected over a longer range, in degrees of engine rotation, the degree of heterogeneity of the inducted fuel-air mixture within the cylinder is reduced. Should fuel injection end too late causing some fuel to be trapped against a closed intake valve, the fuel will be inducted when said intake valve is reopened. One skilled in the art will note that the upper rotating disk can have two apertures, each aperture alternately permitting light to activate a switching member, the number of light sensitive members equal to one half the number of fuel injectors. This method however, will require electronic means for each light sensitive member to control each of two fuel injectors alternately. The sealed beam lamp 20 can incorporate a second stand-by filament which can be energized in emergency across a special switch should the first filament fail. Both filaments can be energized across the ignition switch in the start and/or run position, and also across an oil pressure switch.

Should it be desired to supply an air-fuel mixture within the intake manifold in place of individual cylinder fuel injection, the hereinbefore described controlling and switching mechanism can be used to intermittently actuate one or more fuel injectors to supply fuel to said manifold. To assist in having a desired fuel-air mixture the air intake manifold throttle valve control mechanism can be connected to the fuel and switching mechanism control rod to operate jointly.

It is most important to observe that the introduction of an aperture in the illustrated intermediate controlling disks also introduces a shutter, and that the plurality of apertures is accompanied by an equal number of shutters. One can use apertures and/or shutters to describe the controlling disks. Each illustrated optionally rotated controlling disk is in fact a simple device for integrating a group of apertures and shutters to operate together. Obviously if there is only one sensitive member to be activated one shutter will suffice. In describing the intermediate controlling disks the term aperture(s) was used exclusively for explanatory purposes. It is preferable that the aperture in the controlling disk not be too large, so as to help prevent activation of a switching member by extraneous radiant energy.

One skilled in the art will also note that the illustrated mechanism can be adapted for controlling compression ignition engines; particularly those engines using a common rail fuel injection system.

While those embodiments of this invention hereinbefore illustrated and described are fully capable of performing the objects and accomplishing the advantages primarily stated, it will be understood that this invention is not restricted to the specific embodiments hereinbefore set forth, but includes all modifications coming within the scope of the claims that follow.

I claim:

1. In a fuel injection system for an internal combustion engine, a controlling and switching mechanism using radiant energy for controlling the sequential operation of the fuel injectors, said mechanism comprising:

A source of radiant energy

A first element having a plurality of switching members which are sensitive to said radiant energy, said members fixed to said element and electrically connected in the circuit controlling their associated fuel injectors A revolving beam of said radiant energy directed toward said element, said beam revolving in timed relationship with the engine shaft A second element disposed between the revolving beam of radiant energy and said switching members, said element having a plurality of apertures therein through which said beam is directed; there being an aperture for each switching member; said second element adapted for optional rotation so as to partially expose each switching member to said beam by means of its associated aperture; the length of an energizing pulse when said switching meember is activated by the radiant energy, in degrees of engine shaft rotation, being a function of that part of the switching member exposed to said beam radiant energy

2. The invention defined in claim 1 in which the revolving beam of radiant energy is a recurring beam of radiant energy recurring in timed relationship with the engine shaft.

3. In a fuel injection system for an internal combustion engine, a controlling and switching mechanism using radiant energy for controlling the sequential operation of the fuel injectors, said mechanism comprising:

A source of radiant energy

A revolving beam of said radiant energy, said beam revolving in timed relationship with the engine shaft A first element toward which said revolving beam is directed; said element adapted for optional movement, and having a plurality of switching members which are sensitive to said radiant energy, said members fixed to said element and electrically connected in the circuit controlling their associated fuel injectors A second element disposed between the revolving beam of radiant energy and said switching members, said element having a purality of apertures therein through which said beam is directed, there being an aperture for each switching member; the length of an energizing pulse when said switching member is activated by the radiant energy, in degrees of engine shaft rotation, being a function of that part of the switching member exposed to said beam of radiant energy by means of its associated aperture.

4. In a fuel injection system for an internal combustion engine, a controlling and switching mechanism using radiant energy for controlling the sequential operation of the fuel injectors, said mechanism comprising:

A source of radiant energy

A first element having a plurality of switching members which are sensitive to said radiant energy, said members fixed to said element and electrically connected in the circuit controlling their associated fuel injectors A revolving beam of said radiant energy directed toward said element, said beam revolving in timed relationship with the engine shaft A second element disposed between the revolving beam and said switching members; said second element having a plurality of shutters arranged to function concurrently, there being a shutter for each switching member; either of the two aforementioned elements adapted for optional movement so as to partially expose each switching member to said beam; the length of an energizing pulse when said switching member is activated by the radiant energy, in degrees of engine shaft rotation, being a function of that part of the switching member exposed to said beam of radiant energy.

5. The invention defined in claim 4 in which the shutters are joined to form a rigid element.

6. The invention defined in claim 4 in which the revolving beam is a recurring beam, recurring in timed relationship with the engine shaft.

7. The invention defined in claim 4 in which the radiant energy is light.

8. In a fuel injection system for an internal combustion engine, a controlling and switching mechanism using radiant energy for controlling the sequential operation of the fuel injectors, said mechanism comprising:

A source of radiant energy

A first element having a plurality of switching members which are sensitive to said radiant energy, said members fixed to said element and electrically connected in the circuit controlling their associated fuel injectors A revolving beam of said radiant energy directed toward said element, said beam revolving in timed relationship with the engine shaft A second element disposed between the revolving beam of radiant energy and said switching members, said element having a plurality of apertures therein through which said beam is directed; there being one aperture for each switching member, said second element adapted for optional rotation so as to partially expose each switching member to said beam by means of its associated aperture; the length of an energizing pulse when said switching member is activated by the radiant energy, in degrees of engine shaft rotation, being a function of the relative position of the switching member with respect to its associated aperture A third element disposed intermediate said switching members and the beam of radiant energy, said third element having an aperture for each switching member; said third element held in fixed position with respect to said switching members.

9. In a fuel injection system for an internal combustion engine, a controlling and switching mechanism using radiant energy to control the operation of each fuel injector, said mechanism comprising:

A source of radiant energy

A recurring beam of said radiant energy, said beam recurring in timed relationship with the engine shaft A first element having at least one switching member which is sensitive to said radiant energy, said member electrically connected in the circuit controlling its associated fuel injector, and having sufficient magnitude along at least one dimension so that varying parts of the switching member along said dimension can be optionally exposed to the beam of radiant energy directed toward said first element, thereby varying engine load A second element disposed intermediate the beam of radiant energy and the first element and having an aperture therein through which said beam is directed, there being an aperture for each switching member; either of the aforementioned two elements being adapted for optional movement so as to expose part of each switching member to said beam by means of its associated aperture; the length of an energizing pulse when said switching member is activated by the radiant energy, in degrees of engine shaft rotation, being a function of that part of the switching member exposed to said beam of radiant energy.

10. In a fuel injection system for an internal combustion engine, a controlling and switching mechanism using radiant energy to control the operation of each fuel injector, said mechanism comprising:

A source of radiant energy

A recurring beam of said radiant energy, said beam recurring in timed relationship with the engine shaft A first element having at least one switching member which is sensitive to said radiant energy, said member electrically connected in the circuit controlling its associated fuel injector, and having sufficient magnitude along at least one dimension so that varying parts of the switching member along said dimension can be optionally exposed to the beam of radiant energy directed toward said first element, thereby varying engine load A second element disposed intermediate the beam of radiant energy and the first element and having a shutter for each switching member; either of the aforementioned two elements adapted for optional movement so as to expose part of each switching member to said beam; the length of an energizing pulse when said switching member is activated by the radiant energy, in degrees of engine shaft rotation, being a function of that part of the switching member exposed to said beam of radiant energy.

11. In a fuel injection system for an internal combustion engine, a controlling and switching mechanism using radiant energy to control the operation of each fuel injector, said mechanism comprising:

A source of radiant energy

A first element revolving in timed relationship with the engine shaft, and having an aperture therein from which a beam of said radiant energy emanates; a centrifugally operated shutter disposed on said first element to vary the area of said aperture through which said beam of radiant energy is directed A second element having at least one switching member which is sensitive to said radiant energy, said member electrically connected in the circuit controlling its associated fuel injector, and having sufficient magnitude along at least one dimension so that varying parts of the switching member along said dimension can be exposed to the beam of radiant energy emanating from said aperture and directed toward said second element A third element disposed intermediate said emanating beam of radiant energy and said second element, and having a shutter for each switching member;

either of the latter two aforementioned elements adapted for optional movement so as to expose part of each switching member to the recurring beam of radiant energy; the length of an energizing pulse when said switching member is activated by the radiant energy, in degrees of engine shaft rotation, being a function of that part of the switching member exposed to said beam of radiant energy.

* * * * *